US006978876B1

(12) United States Patent
Tsukahara et al.

(10) Patent No.: US 6,978,876 B1
(45) Date of Patent: Dec. 27, 2005

(54) STEP FOR ESCALATOR

(75) Inventors: Yoshio Tsukahara, Chiba (JP); Kazuhiko Motomura, Chiba (JP); Takashi Tanaka, Chiba (JP); Koichi Maeda, Tokyo (JP)

(73) Assignee: Otis Elevator Company, Farmington, CT (US)

( * ) Notice: Subject to any disclaimer, the term of this patent is extended or adjusted under 35 U.S.C. 154(b) by 112 days.

(21) Appl. No.: 10/070,712

(22) PCT Filed: Sep. 6, 2000

(86) PCT No.: PCT/US00/24408

§ 371 (c)(1),
(2), (4) Date: Mar. 5, 2002

(87) PCT Pub. No.: WO01/17888

PCT Pub. Date: Mar. 15, 2001

(30) Foreign Application Priority Data

Sep. 7, 1999 (JP) ..... 11/252446

(51) Int. Cl.[7] ..... B66G 23/12
(52) U.S. Cl. ..... 198/333
(58) Field of Search ..... 198/333

(56) References Cited

U.S. PATENT DOCUMENTS

| | | | | | |
|---|---|---|---|---|---|
| 4,984,672 | A | | 1/1991 | Saito et al. | |
| 4,984,673 | A | * | 1/1991 | Saito et al. | 198/333 |
| 5,337,879 | A | * | 8/1994 | Fischer | 198/333 |
| 5,350,049 | A | * | 9/1994 | Ahls et al. | 198/333 |
| 5,441,140 | A | * | 8/1995 | Reid | 198/333 |
| 5,560,468 | A | | 10/1996 | Inoue | |
| 5,785,167 | A | | 7/1998 | Rugg | |
| 5,810,148 | A | * | 9/1998 | Schoeneweiss | 198/333 |
| 5,950,267 | A | * | 9/1999 | Ricci, Jr. | 14/71.1 |

* cited by examiner

*Primary Examiner*—Khoi H. Tran

(57) ABSTRACT

An escalator step riser is improved by adding grooves to the cleat surfaces, and, at the same time, a skid-inhibiting function is realized at the rear edge of the step. For escalator step (1), cleats (5*a*) are formed with a pitch twice that of tread (4) on riser (3). On each cleat (5*a*) of the riser (3), one or more grooves (6) are formed in the longitudinal direction. In addition, skid-inhibiting surface (7), made of synthetic resin and having a prescribed width, is attached in a quick connecting/disconnecting manner on the rear edge of step (2). A serrated irregular portion (7*c*) is formed on the upper surface of cleats (7*a*), (7*b*) of the non-slip surface (7).

9 Claims, 5 Drawing Sheets

FIG.8A
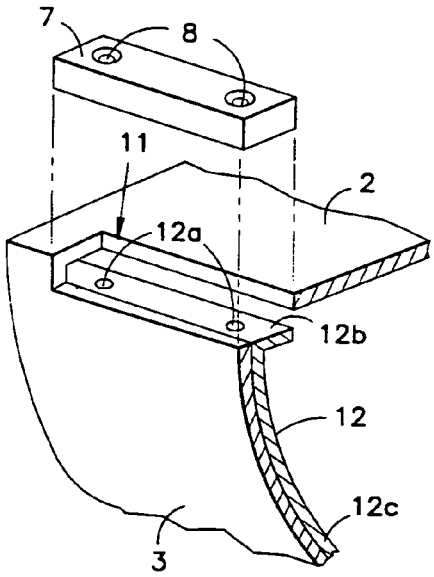
FIG.9A
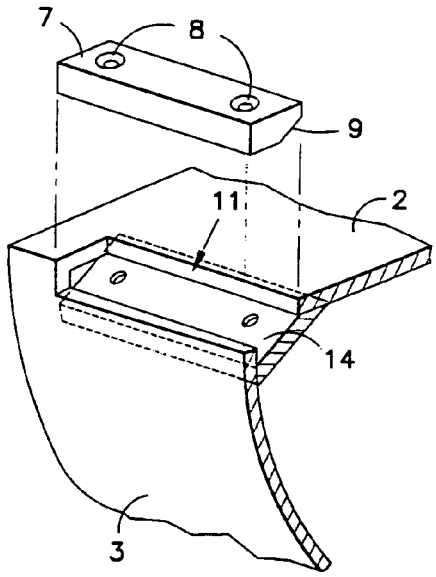
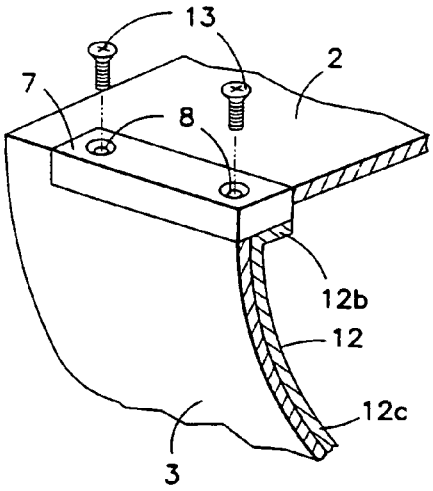
FIG.8B
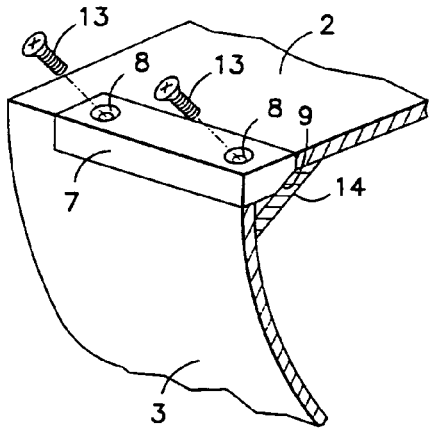
FIG.9B

STEP FOR ESCALATOR

TECHNICAL FIELD OF THE INVENTION

This invention relates to an escalator step and, in particular, to a step structure that improves safety.

BACKGROUND OF THE INVENTION

A step for an escalator is comprised of a horizontal step and a riser which hangs downward from the rear edge thereof and has a curved surface. It is typical to have a non-slip function provided to the step by forming a tread made of cleats and of a toothed surface formed on the riser made of cleats, with the pitch of the riser cleats being twice that of the step tread. It has been effective to form the toothed surface of cleats, which engage with the step tread, to the riser in order to minimize the danger of articles falling between steps, and the danger of rubber shoes, etc. being dragged between steps having a smooth surface. Therefore, this has been applied in most risers of steps for escalators in recent years.

However, there are still cases of shoes being pulled between steps due to the rubber part of the shoes sliding and contacting the toothed surface of the riser. Therefore, it is desirable to improve this in order to maintain safety on an escalator. Also, the rear edge of a step formed with a tread can cause the tip of a shoe to slip and there is a danger of loss of footing.

Japanese Kokai Patent Application Number Hei 1[1989]-285581 discloses a solution of applying a surface finishing process to the surface of a riser by using a fluorine resin. Fluorine resin is expensive and causes an increase in the cost of manufacturing a step for an escalator due to the process for coating the fluorine resin. There were additional problems, however, such as lack of durability due to the fluorine resin tending to wear out easily. The work of disassembling the entire escalator and removing steps to be repaired become necessary in order to repaint worn fluorine resin. This results in a lack of availability of the escalator during this time and an associated increase in maintenance cost.

SUMMARY OF THE INVENTION

This invention was achieved by considering the aforementioned situation and improves the step for an escalator by providing a non-slip function to the rear edge of the step, along with improving the riser in order to minimize the risk of drag-in between steps.

In order to solve the aforementioned problems, this invention provides a step for an escalator having a toothed surface made of cleats and a riser which hangs downward with a curved surface from the rear edge of a horizontal step, with one or more grooves formed in the longitudinal direction of the riser cleats.

Therefore, the smooth surface of a riser cleat is eliminated due to grooves being provided to each cleat forming the toothed surface of the riser, and the danger of dragging in of rubber shoes can be minimized or prevented.

Also, a step for an escalator is provided with a riser having a curved surface which hangs downward from the rear edge of a horizontal step, and a non-slip surface of a prescribed width and a fixed length mounted detachably at the rear edge of the step.

Therefore, danger of shoes slipping inadvertently can be prevented since a non-slip function is provided to the rear edge of the step.

In a particular embodiment, the non-slip surface is composed of a synthetic resin body of a fixed length and approximately the same width as a prescribed demarcation width to be applied at the periphery of the step and is a material of greater frictional resistance than metal. Also, a serrated irregular part is formed on the top surface of the cleats of the non-slip surface. Furthermore, the height of the cleats of the non-slip surface is formed to be higher than the tread. Furthermore, the non-slip surface can be fastened with screws to a reinforcing plate, which is fixed within the cleat cutout part of the step.

BRIEF DESCRIPTION OF THE DRAWINGS

FIG. 8 is a schematic perspective view for an assembling example of a non-slip member.

FIG. 9 is a schematic perspective view for another assembling example of a non-slip member.

BEST MODE FOR CARRYING OUT THE INVENTION

Figure 1:
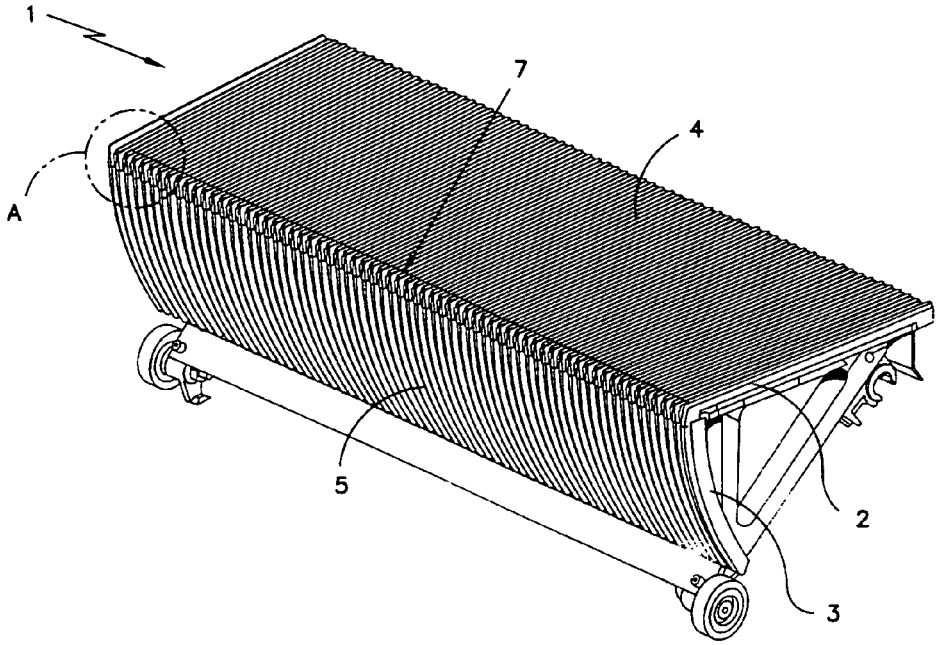
FIG. 1 is a perspective view of the step for an escalator related to this invention.
Figure 2:
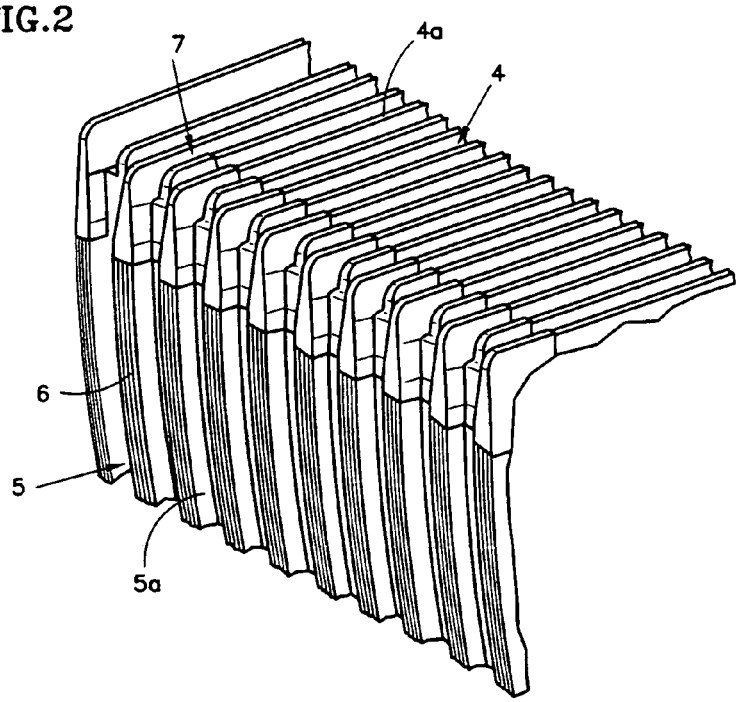
FIG. 2 is an enlarged view within circle A in FIG. 1.

Below, embodiments of this invention will be explained by referring to the appended figures. Escalator step (1) shown in FIG. 1 and FIG. 2 has step (2) which maintains a horizontal surface and riser (3) which hangs downward in a curved shape from the rear edge of step (2), tread (4) comprised of plural cleats **(4*a*) is formed on the top surface of step (2) along with toothed surface (5) composed of plural cleats (5*a*) having a pitch twice that of tread (4) being formed to the surface of riser (3). Along with grooves (6) being formed on each cleat (5*a*) which forms toothed surface (5), non-slip surface (7) is mounted to be detachable at the rear edge of escalator step (1) at which tread (4) and toothed surface (5)** meet.

Figure 3A:
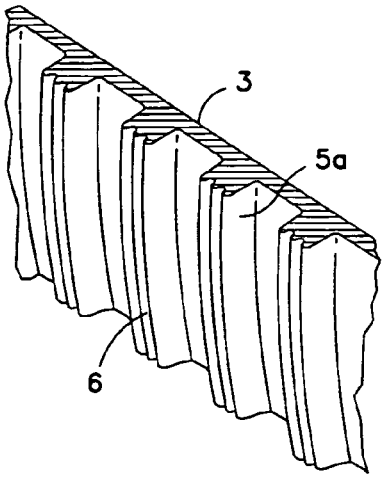
FIG. 3(A) is a partially sectioned perspective view of the riser shown in FIG. 1 and (B) is a partial top view thereof.
Figure 3B:
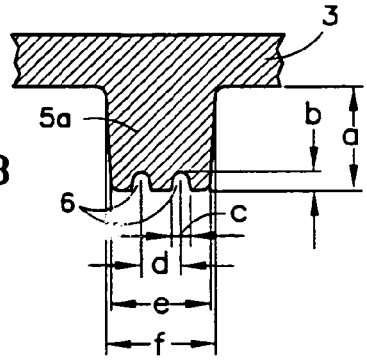
Figure 4A:
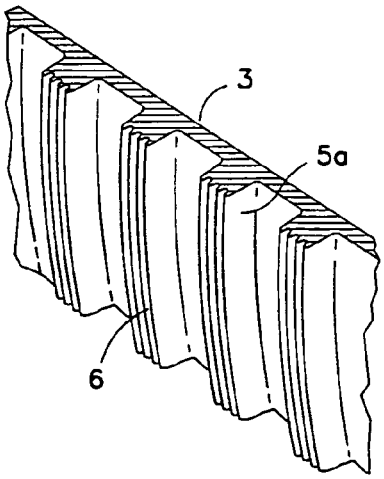
FIG. 4(A) is a partially sectioned perspective view in another example of the riser shown in FIG. 1 and (B) is a partial top view thereof.
Figure 4B:
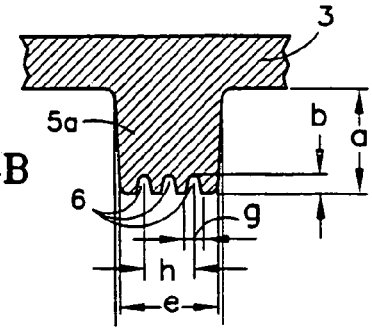
Figure 5A:
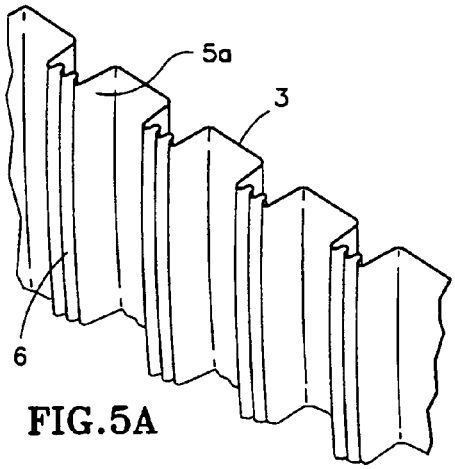
FIG. 5(A) is a partially sectioned perspective view in yet another example of the riser shown in FIG. 1 and (B) is a partial top view thereof.
Figure 5B:
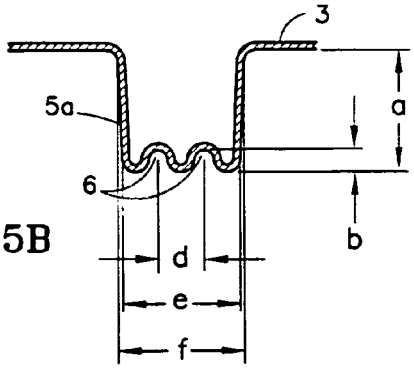
Figure 6A:
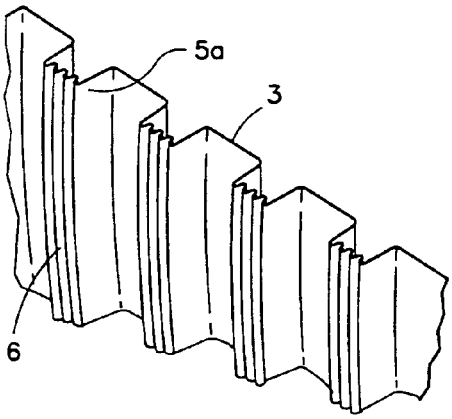
FIG. 6(A) is a partially sectioned perspective view in yet another example of the riser shown in FIG. 1 and (B) is a partial top view thereof.
Figure 6B:
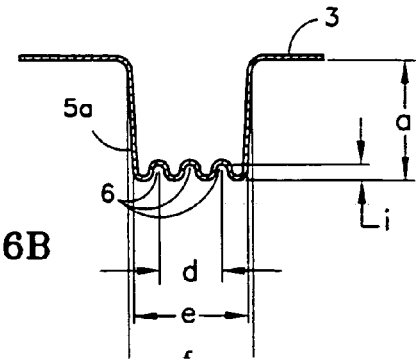

Grooves (6) are 2–3 grooves which are formed in the longitudinal direction on the surface of each cleat **(5*a*) comprising toothed surface (5) as shown in FIG. 3–FIG. 6. The examples shown in FIG. 3 and FIG. 4 show cases when riser (3) is composed of a thick plate of die cast aluminum, etc. and the examples in FIG. 5 and FIG. 6 shows cases when riser (3) is composed of a thin stainless steel plate, etc. With regard to grooves (6), two are formed parallel along cleat (5*a*) in FIG. 3 and FIG. 5 or three are formed parallel along cleat (5*a*) in FIG. 4 and FIG. 6. The preferred dimensions for each part shown in FIG. 3(B)–FIG. 6**(B) are noted in detail in the item of the application example.

Grooves (6) are formed simultaneous with the die casting or pressing. Or, naturally, it is possible to form grooves (6) to cleat **(5*a*) by machining after the formation of riser (3) by die casting. Also, the number of strip grooves (6) in each cleat (5***a*) is not restricted to that shown in the figures. Namely, all that is necessary is to make the area of the surface that the rubber shoes contacts in addition to the two die surfaces of each strip bump (5*a*) as small as possible and not to deform the rubber portion of the shoe when contact is made.

Figure 7A:
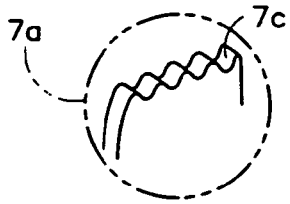
FIG. 7 is a disassembled perspective view of a non-slip member.
Figure 7:
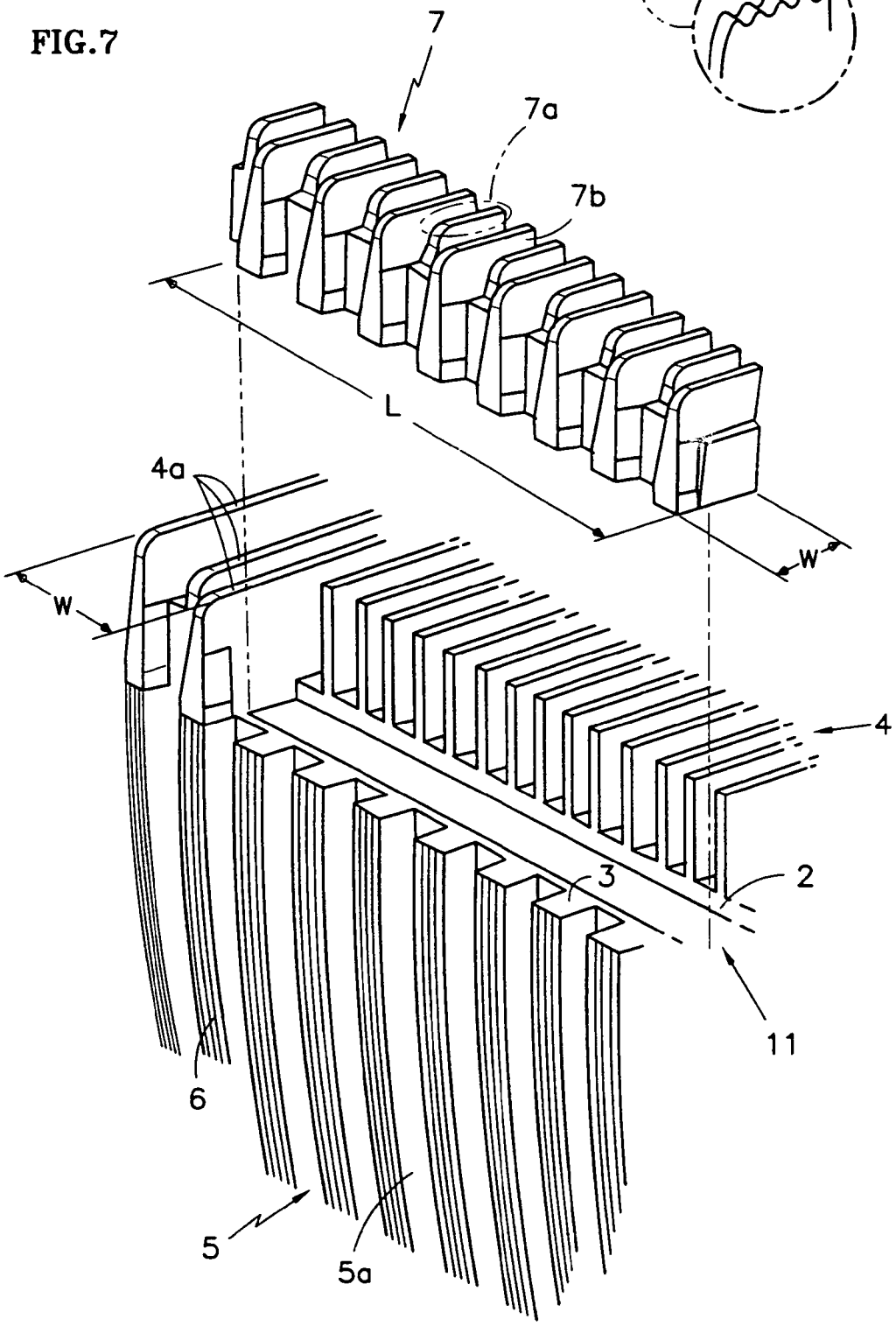

Also, non-slip surface (7) is a synthetic resin molded body which is a material having a greater frictional resistance than metal and has fixed length (L) and approximately the same width (W) as the demarcation width, with the exception of one portion (2–3 cleat bumps (4*a*)) of tread (4) applied with marking consisting of a yellow indicator for indicating the lateral boundary of the step at the periphery of step (2) as shown in FIG. 7. Therefore, if the synthetic resin molded body is formed with a yellow material, it can replace a demarcation at the rear edge of the step.

Along with alternately forming cleats (7*a*) of slightly higher height and the same pitch interval as tread (4) and cleats (7*b*) of the same pitch interval as cleats (5*a*) and adjacent to cleats (7*a*) to this synthetic resin molded body, serrated irregular part (7*c*) is formed to the top surface of strip bumps (7*a*) and (7*b*) as indicated within the circle in the figure. Cleats (7*a*) and (7*b*) can be formed to be slightly higher than cleats (4*a*) so that the tips of shoes become caught.

In order to mount this non-slip surface (7) to escalator step (1), screw holes (8, 8) are perforated between cleats (7*a*) and (7*b*) at the top surface of non-slip surface (7) and cleat cutout part (11) is formed to the rear edge of step (2). It is preferably, if possible, to provide screw holes (12*a*, 12*a*), which conform with the screw holes of non-slip member (7) to cleat cutout part (11).

If not possible, reinforcing plate (12) is provided to cleat cutout part (11) as shown in simplified FIGS. 8(A) and (B). This reinforcing plate (12) is formed by horizontal part (12*b*) with screw holes (12*a*) and (12*a*) which conform with screw holes (8) and (8) perforated in non-slip surface (7) at the end part of curved surface part (12*c*). The plate (12) is suitably fixed so that curved surface part (12*c*) contacts the inside surface of riser (3), and the top surface of horizontal part (12*b*) is maintained at approximately the same height as the top end surface on the riser (3) of cleat cutout part (11). Therefore, joining to reinforcing plate (12) is done by fitting non-slip surface (7) into cleat cutout part (11) and engaging fasteners (13) and (13) into screw holes (8) and (8).

Alternatively, as shown in similarly simplified FIGS. 9(A) and (B), slanted reinforcing plate (14) which links the inside surfaces of riser (3) and step (2) is coupled to the inside part of cleat cutout part (11) by welding, etc. Contact surface (9) is formed by cutting a bottom angular part on the step (2) side of non-slip surface (7) so as to be parallel to the slanted angle of reinforcing plate (14). Screw holes (8) and (8) are perforated at a slant so as to be orthogonal to reinforcing plate (14) fasteners (13) are engaged into screw holes (8) and (8) at a slant, and non-slip surface (7) and reinforcing plate (14) are joined.

Other alternatives include forming an extension on the non-slip surface 7. Instead of using fasteners at the bottom part of non-slip surface (7), the extension can be inserted into hole (12*a*) and fixed by fastening with a ring, etc. on the back side of step (2). Another alternative includes an extension that expands after press fitting and inserting it into hole (12*a*). In these cases, there is a disadvantage of needing to disassemble the entire escalator during maintenance such as when replacing non-slip surface (7), as opposed to the configuration using screw fastening, in which maintenance such as replacement of the non-slip surface is possible without disassembling the entire escalator.

Non-slip member(7) can be conformed in length by fabricating a fixed, prescribed length member, fixing this to cleat cutout part (11) as an extension, and suitably cutting if the length thereof [of cleat cutout part] is insufficient.

Suggested dimensions in FIG. 3(B), FIG. 4(B), FIG. 5(B), and FIG. 6(B) are about (a) 6.00 mm, (b) 1.00 mm, (c) 1.50 mm, (d) 2.50 mm, (e) 6.00 mm, (f) 7.00 mm, (g) 1.00 mm, (h) 3.00 mm, and (i) 0.3 mm. Also, if groove (6) has two grooves, the curvature radius at the awl part of the waveform in strip bump (5*a*) is 0.05 mm and if groove (6) has three grooves, the curvature radius of the awl part of the waveform in strip bump (5*a*) is 0.03 mm.

According to this invention as explained above, one or more grooves are provided to the surface of each cleat forming the toothed surface of the riser so that even if rubber shoes, etc. contact the cleat, the grooves do not cause adhesion by creating a pneumatic layer, and thus the danger of dragging in shoes, etc. between steps is minimized or eliminated, and a significant decrease in maintenance cost results compared to repainting the step with fluorine resin. Furthermore, a non-slip surface is provided to the rear edge of the step so that danger of shoes slipping at the rear edge of the step can be prevented.

Also, the non-slip surface is formed with a synthetic resin plate of a fixed length and the same width as a prescribed demarcation width, so naturally, in addition to being able to be manufactured inexpensively with a synthetic resin and functioning also as a demarcation, an effective non-slip function is manifested due to the synthetic resin material having greater frictional resistance than a metal.

Also, the cleat in the non-slip member is made slightly higher than the height of the tread so that shoe tips may be engaged. Also, an irregular part is formed at the top surface to create a more effective non-slip function.

Furthermore, the non-slip surface is configured to be attachable and detachable to the cleat cutout part of the step, so if one portion of the non-slip member breaks off, this part can be replaced immediately and a great decrease in maintenance cost can be made compared to replacing the entire step.

What is claimed is:

1. An escalator step including a tread and a riser, the riser extending downward from a rear edge of the step, the riser including a toothed surface made of cleats with one or more grooves formed in the longitudinal direction on the surface of each of the cleats.

2. An escalator step including a tread and a riser, the riser extending downward from a rear edge of the step and the tread extending a tread length from the rear edge of the step, the step including a non-slip surface of a fixed length and a prescribed width mounted to the rear edge of the step, the prescribed width extending in a same direction as the tread length and the prescribed width is less than the tread length of the tread.

3. An escalator step according to claim 2, wherein the tread is formed of cleats and the non-slip surface is comprised of a synthetic resin body and is formed with cleats conforming to the step tread.

4. The escalator step according to claim 2 or 3, further including a serrated irregular part formed on the top surface of of the non-slip surface.

5. The escalator step according to claim 3, wherein the height of the cleats of the non-slip surface are formed to be higher than the tread.

6. The escalator step according to claim 2 or 3, wherein the step includes a cleat cutout part and the rear edge is fastened to a reinforcing plate which is fixed within the cleat cutout part.

7. An escalator step according to claim 2, wherein the non-slip surface is comprised of a synthetic resin body.

8. An escalator step according to claim 2, wherein step includes a demarcation width applied at a periphery of the step, the prescribed width is the same as the demarcation width.

9. An escalator step according to claim 2, wherein the non-slip surface is detachably mounted as the rear edge of the step.

* * * * *